United States Patent [19]

Kakuno et al.

[11] Patent Number: 4,913,750

[45] Date of Patent: Apr. 3, 1990

[54] AMORPHOUS MAGNETIC WIRE

[75] Inventors: Keiichi Kakuno, Yokohama; Tutomu Yamada, Machida; Sumio Masuda, Tokyo, all of Japan

[73] Assignee: Jeco Company Limited, Gyoda, Japan

[21] Appl. No.: 163,432

[22] Filed: Mar. 3, 1988

[30] Foreign Application Priority Data

Mar. 6, 1987 [JP] Japan ..... 62-52735
Oct. 9, 1987 [JP] Japan ..... 62-253515

[51] Int. Cl.[4] ..... H01F 1/00

[52] U.S. Cl. ..... 148/304; 148/902; 428/611; 428/928

[58] Field of Search ..... 148/304, 307, 403, 902; 428/928, 611

[56] References Cited

U.S. PATENT DOCUMENTS 3,820,090 6/1974 Wiegand ..... 428/928
4,247,601 1/1981 Wiegand ..... 428/928

FOREIGN PATENT DOCUMENTS 64948 5/1980 Japan .

OTHER PUBLICATIONS

"Mechanical Properties of Fe-Si-B Amorphous Wires Produced by In-Rotating-Water Spinning Method", Metall. Trans. A, vol. 13A, pp. 373, 382, Mar. 1982.

*Primary Examiner*—Melvyn J. Andrews
*Assistant Examiner*—George Wyszomierski
*Attorney, Agent, or Firm*—Pennie & Edmonds

[57] ABSTRACT

An amorphous magnetic wire comprises a magnetically hard wire portion for propagating a magnetoelastic wave, and a magnetically soft wire portion for generating or detecting the magnetoelastic wave. This amorphous magnetic wire is obtained by producing a magnetic wire in an amorphous state, wire-drawing the amorphous magnetic wire so as to make the amorphous magnetic wire thinner, and annealing a portion of the magnetic wire to make the portion magnetically soft.

6 Claims, 6 Drawing Sheets

AMORPHOUS MAGNETIC WIRE

BACKGROUND OF THE INVENTION

The present invention generally relates to an amorphous magnetic wire and its method of production, and in particular to an amorphous magnetic wire which is applicable to magnetoelastic wave devices such as frequency filters, signal delay lines, position detecting sensors, non-volatile memories and the like, and the method of producing the above amorphous magnetic wire.

Conventionally, such magnetoelastic devices have been widely used in various fields. Magnetic substances used in magnetoelastic devices are required to have the following magnetic properties. The required magnetic properties are such that firstly magnetoelastic waves are easily generated in the magnetic substances, secondly magnetoelastic waves propagate through the magnetic substances with a low attenuation rate, and thirdly magnetoelastic waves in the magnetic substances are easily detected.

Recently, amorphous magnetic substances have become used. Amorphous magnetic substances satisfy the above requirements well, compared to other substances. Generally, amorphous magnetic substances are shaped like a thin film or thin ribbon. Presently, magnetic substances which are formed in a fine wire shape have been developed and recognized.

Mechanisms for the generation and detection of magnetoelastic waves in the amorphous magnetic substances are as follows. When magnetic field is applied to a portion of a magnetic substance by use of a coil for example, variations in magnetization following a magnetization curve are generated in the magnetic substance as variations in the applied magnetic field. The variations in magnetization cause magnetostriction, which is propagated through the magnetic substance as elastic waves. The elastic waves are magnetoelastic waves. Adversely, when there exist the magnetoelastic waves in the magnetic substance, the magnetostriction causes variations in magnetization due to an inverse magnetostrictive effect. The variations in magnetization changes a magnetic field around the magnetic substance. Therefore, it is possible to detect the variations in magnetization in the magnetic substance by use of a coil for example.

As described above, the magnetization properties and the magnetostriction play or the inverse magnetostriction an important role in the generation and detection of the magnetoelastic waves. That is, an decrease in the coercive force means that the magnetic substance becomes softer. The smaller coercive force generates the greater variations in magnetization in response to the smaller variations in the magnetic field. Therefore, the generation and detection of the magnetoelastic wave becomes easier. Alternatively, an increase in the coercive force means that the magnetic substance becomes harder. Therefore, the generation and detection of the magnetoelastic waves become more difficult. In addition, when the coercive forces are the same, the greater the magnetostriction, the easier are the generation and detection of the magnetoelastic waves. Both the relationship between the magnetic field and the magnetization, and the relationship between the magnetization and magnetostriction or inverse magnetostriction have an effect on a mutual function between the magnetic field and the magnetostriction, i.e., magnetoelastic coupling. As the magnetoelastic coupling becomes greater, the generation and detection may be made more easily.

On the other hand, when the magnetoelastic coupling is large, the magnetization varies with time due to the magnetoelastic waves propagated through the magnetic substance. The variations in the magnetization cause an eddy current, and thus increase a loss of propagation. The propagation loss increases as frequencies of the magnetoelastic waves increase.

As described above, the first and third requirements are opposite to the second requirement. That is, for magnetic substances having a large magnetoelastic coupling, the generation and detection of the magnetoelastic waves are relatively easy, but the propagation loss is large. On the other hand, for magnetic substances having a small magnetoelastic coupling, the magnetoelastic waves may be propagated through the magnetic substance with a low attenuation, but it becomes difficult to produce and detect the magnetoelastic waves.

Consequently, it is presently impossible to realize a magnetoelastic wave device capable of generating, propagating and detecting the magnetoelastic waves efficiently and effectively.

The conventional magnetoelastic substances has the following disadvantage. When trying to generate the magnetoelastic waves in the magnetic substance by a relatively simple device such as a coil or the like, the magnetic field of the driven coil is applied to the magnetic substance over a considerable length. Therefore, magnetoelastic waves which are excited at various portions within the range interfere each other, and are thus attenuated. Likewise, when trying to detect the variations in the magnetic field by a coil, the coil picks up the variations in the magnetization within the magnetic substance over its long length. This degrades an efficiency in detecting the magnetoelastic waves. It is noted that the above problems at the time of the generation and detection of the magnetoelastic waves become greater as frequencies of the magnetoelastic waves increase.

In order to solve the above problems, a combination of magnetic substances with different substances such as piezo materials has been proposed. The magnetic substance is used to propagate the magnetoelastic waves, and the piezo material is used to generate and detect the magnetoelastic waves. However, the structure of the magnetoelastic wave device is very complex and expensive.

SUMMARY OF THE INVENTION

Accordingly, a general object of the present invention is to provide a novel and useful amorphous magnetic wire in which the disadvantages of the conventional amorphous magnetic wire have been eliminated.

A more specific object of the present invention is to provide an amorphous magnetic wire capable of generating, propagating and detecting magnetoelastic waves effectively and efficiently.

Another object of the present invention is to provide an amorphous magnetic wire in which high-frequency characteristics are improved.

The above objects of the present invention are achieved by an amorphous magnetic wire comprising a magnetically hard wire portion for propagating a magnetoelastic wave, and a magnetically soft wire portion for generating or detecting the magnetoelastic wave.

Still another object of the present invention is to provide a method of producing an amorphous magnetic wire having the above features.

This object of the present invention is achieved by a method of producing an amorphous magnetic wire comprising the steps of producing a magnetic wire in an amorphous state, wire-drawing the amorphous magnetic wire so as to make the amorphous magnetic wire thinner, and annealing a portion of the magnetic wire to make the portion magnetically soft.

Other objects, features and advantages of the present invention will become apparent from the following detailed description when read in conjunction with the accompanying drawings.

DETAILED DESCRIPTION

An amorphous magnetic wire according to the present invention is produced by producing a magnetic wire in an amorphous state, wire-drawing the amorphous magnetic wire so as to make the amorphous magnetic wire thinner, and annealing a portion or portions of the magnetic wire to make the portions magnetically soft. For example, an amorphous magnetic wire is produced by subjecting an amorphous magnetic wire made by an in-rotating-liquid spinning method to a cold wire drawing process, and carrying out heat treatment, i.e., annealing treatment for a desired portion or portions of the drawn magnetic wire. The cold wire drawing process is aimed at providing the magnetic wire with the hard magnetic property of a small magnetoelastic coupling. The annealed portions of the magnetic wire are provided with the soft magnetic property of a large magnetoelastic coupling. The amorphous wire thus produced has magnetically hard portions, and magnetically soft portions.

The magnetically hard portions of the magnetic wire can be used for the propagation of the magnetoelastic waves, and the magnetically soft portions subjected to the annealing treatment can be used for the generation and detection of the magnetoelastic waves. The magnetically hard portions of the magnetic wire can propagate the magnetoelastic waves without much attenuation, because the magnetoelastic coupling thereof is small. The magnetically soft portions are suitable for the generation and detection of the magnetoelastic waves, because the magnetoelastic coupling thereof is large. Therefore, the amorphous magnetic wire according to the present invention is capable of not only propagating the magnetoelastic waves with a low attenuation rate, and but also generating and detecting the magnetoelastic waves efficiently. Preferably, the coercive forces of the magnetically hart and soft portions are infinite and zero, respectively.

The above advantages of the amorphous magnetic wire according to the present invention hold true for magnetoelastic waves of even high-frequencies. This is because a volume of a wire portion for use in the generation and detection can be reduced by a method described later. It should be noted that the interfere between the magnetoelastic waves can be reduced as the volume of the portion at which magnetoelastic waves are generated or detected decreases. This means that the generating or detecting properties are independent of size of coils for the generation and detection.

As will be described later, in order to generate and detect the magnetoelastic waves without much loss, it is preferable to form two annealed portions of the wire which are respectively used for the wave generation and detection.

A description will be given on an embodiment according to the present invention.

Figure 1:
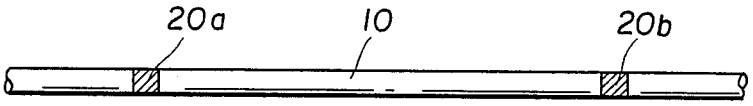
FIG. 1 is a front view of an example of an amorphous magnetic wire according to the present invention.

Referring to FIG. 1, there is shown an amorphous magnetic wire 20 according to the present invention. A conventional amorphous magnetic wire may be obtained by producing a magnetic wire in an amorphous state by a conventional in-rotating-liquid spinning method and subsequently subjecting the magnetic fine wire to a conventional cold wire drawing process. The in-rotating-liquid spinning method (which is also called the in-rotating-water spinning method) is disclosed in M. Hagiwara, et al, "Mechanical Properties of Fe-Si-B Amorphous Wires Produced by In-Rotating-Water Spinning method", Metall. Trans. A, vol. 13A, pp. 373–382, March 1982, or the Japanese Laid-Open Patent Application No. 64948/1980, for example. As disclosed in the documents, a liquid layer is formed due to a centrifugal force in a hollow cylindrical drum which is being rotated. A jet of melted metal is injected into the liquid layer. Therefore, the injected metal is coagulated, so that a wire of metal can be formed. The in-rotating-liquid spinning method makes it possible to form a continuous wire of a diameter up to approximately 0.5 mm. The cold wire drawing process is a well known process in which a metal wire is drawn through a die to diminish the cross area thereof. In general, magnetolastic waves can propagate through the amorphous magnetic wire with smaller propagation loss as the diameter thereof is decreased. An amorphous magnetic wire of a diameter up to 0.02 mm can be obtained without difficulty by the cold wire drawing process.

According to the present invention, an amorphous magnetic wire formed by the above processes are used. An amorphous magnetic substance used in the present invention is preferably a ferromagnetic substance. This is because ferromagnetic substances can produce large magnetostriction which results in easier generation and detection of the magnetoelastic waves. Amorphous substances generate less eddy currents, which results from their high resistivity. Further, the fact that a wire is made thin is an important factor for the propagation properties. The diameter of the magnetic wire of the present invention is made very small, preferably in the order of approximately 0.11 mm or less. Thus, the wire can be considered to be a one-dimensional member. It is noted that a ribbon made of the magnetic substance, which is conventionally used as a magnetoelastic wave propagation medium, has a substantially rectangular cross section. The two-dimensional member causes the propagation loss greater than one-dimensional member. Therefore, the ribbon is considered to be a two-dimensional member. For this reason, compared to the ribbon shape, the wire shape is suitable for use in the propagation of the magnetoelastic waves. From the above viewpoints, an alloy containing Fe as a main component such as Fe-Si-B is suitable for making the amorphous magnetic wire of the present invention. In addition, alloys containing Co or Ni as a main component may be used.

A portion or portions of the magnetic wire thus made are subjected to heat treatment, i.e., annealing treatment. Portions 20*a* and 20*b* of the magnetic wire 20 in FIG. 1 have been subjected to the annealing process. The annealing treatment must be carried out at a temperature which is lower than a crystallization temperature of the magnetic substance forming the magnetic wire 20 and which exceeds a temperature sufficient for producing an annealing effect (change in magnetic properties) in which the hard magnetic property is lost and instead the soft magnetic property occurs. For $Fe_{77.5}Si_{7.5}B_{15}$, its crystallization temperature is equal to approximately 530° C. and a temperature at which the annealing effect occurs is equal to approximately 300° C. or over. The annealing is carried out in $N_2$ ambient atmosphere for preventing oxidation for a few minutes, for example. A temperature range in the annealing treatment is selected depending on a substance to be annealed.

Figure 2:
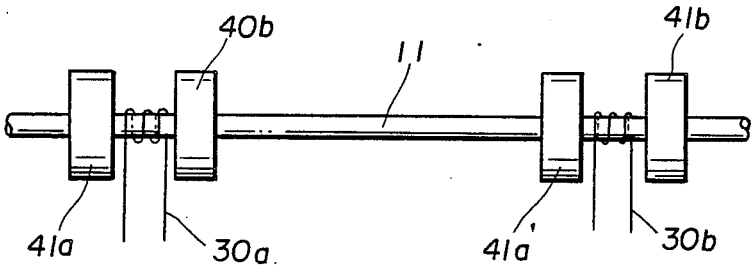
FIG. 2 is a view showing an experimental system for measuring magnetoelastic waves in a magnetic wire.

FIG. 2 is a schematic view showing an arrangement for measuring properties shown in FIGS.3A through 3E. A driving coil 30*a* is wound around a portion of a magnetic wire 11 which is a sample in the experiment. A pick-up coil 30*b* is wound around another portion of the magnetic wire. A tone-burst generator (not shown) is connected to the driving coil 30*a*. An oscilloscope (not shown) is connected to the pick-up coil 30*b* through an amplifier. The driving coil 30*a* is interposed between a pair of Helmholtz coils 40*a* and 40*b*. Likewise, the pick-up coil 30*b* is interposed between a pair of Helmholtz coils 41*a* and 41*b*. The Helmholtz coils 40*a*, 40*b* and 41*a*, 41*b* provide the coils 30*a* and 30*b* with an optimum DC bias magnetic field for generating and detecting magnetoelastic waves, respectively.

FIGS.3A through 3E show experimental results for various magnetic wires made of $Fe_{77.5}Si_{7.5}B_{15}$. In these figures, a horizontal direction indicates time. A vertical direction of FIG. 3A indicates a level of a driving current which flows through the driving coil 30*a*, and a vertical direction of each of FIGS.3B through 3E indicates a level of voltage which is induced at the pick-up coil 30*b*.

Figure 3:
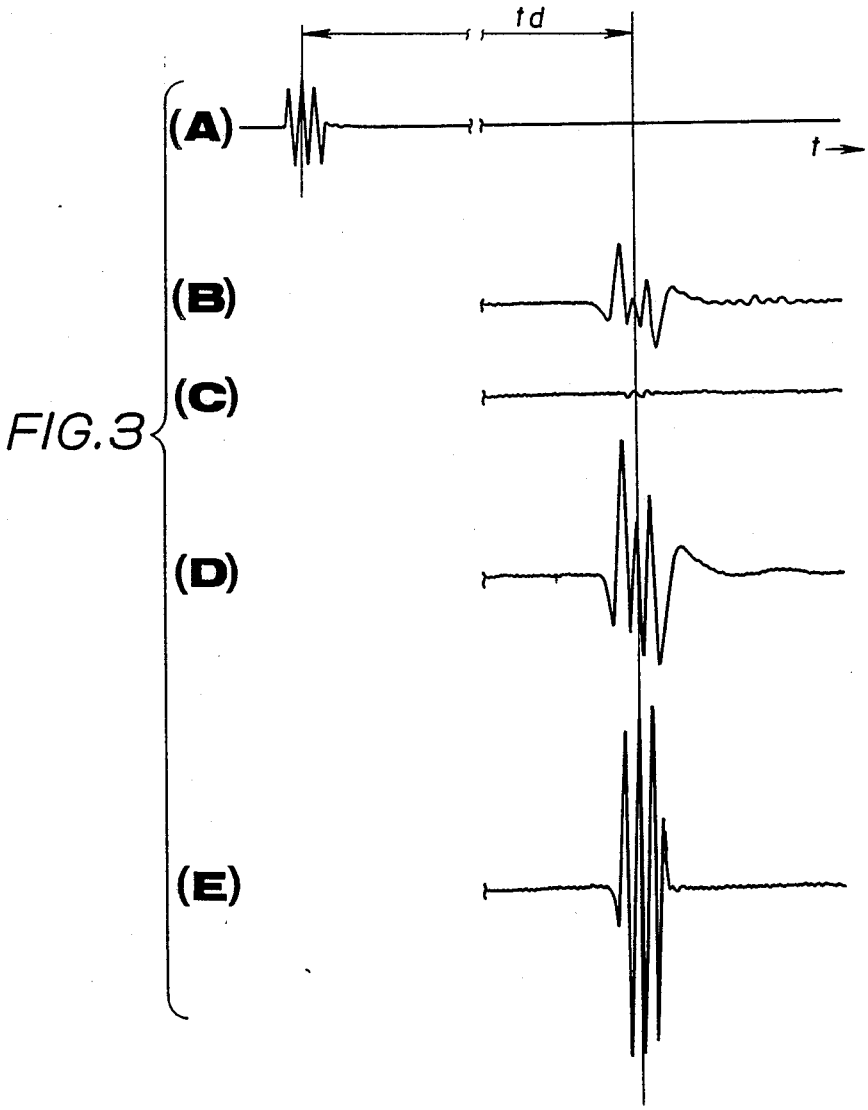
FIGS. 3A through 3E are graphs showing a waveform of a driving current and voltage waveforms detected in the experiment.

FIG. 3A shows a tone-burst current of the driving current through the driving coil 30*a*. The application of the tone-burst current generates magnetoelastic waves at the portion in the vicinity of the driving coil 30*a*. Some of the generated magnetoelastic waves are propagated through the magnetic wire 11 toward the pick-up coil 30*b*. Then, when the magnetoelastic wave reaches the portion around which the pick-up coil 30*b* is wound, a voltage corresponding to the magnetoelastic wave (tone-burst voltage) is generated at the pick-up coil 30*b*, as shown in each of FIGS.3B through 3E.

Figure 4A:
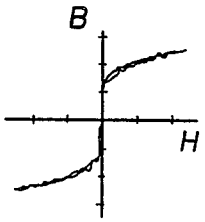
FIGS. 4A through 4C are views showing magnetization curves.

FIG. 3B shows a voltage waveform measured for an as-quenched magnetic wire 11 after the in-rotating-liquid spinning process. As seen from comparison between FIGS.3A and 3B, there is a delay amounting to a propagation delay time $t_d$ between the tone-burst current and the detected voltage. The magnetization curve of the sample in its axial direction is shown in FIG. 4A, in which a horizontal axis indicates a magnetic field (H) and a vertical axis indicates a magnetic flux density (B).

Figure 4B:
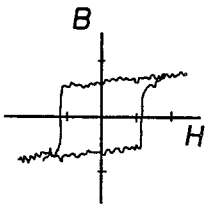

FIG. 3C shows a voltage waveform for a magnetic wire obtained by subjecting the as-quenched magnetic wire to the cold wire drawing process. As described before, the cold wire drawing process is generally aimed at reducing the diameter of the wire. In addition, it can be seen from the magnetization curve of FIG. 4B that this process has a function of increasing the coercive force.

An increase in the coercive force causes a decrease in the magnetoelastic coupling. For this reason, it becomes difficult to generate and detect the magnetoelastic wave. Therefore, as shown in FIG. 3C, the magnetoelastic wave detected becomes far weaker in intensity than that for the as-quenched magnetic wire. However, it should be noted that in this case, the magnetoelastic wave becomes similar to a simple elastic wave. For this reason, the eddy current can be reduced and thus the propagation loss can be decreased.

Figure 4C:
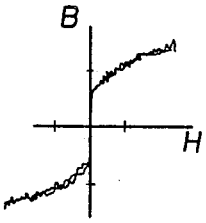

FIG. 3D shows a voltage waveform for a magnetic wire obtained by annealing the whole of the wire-drawn fine magnetic wire at a temperature of 400° C. The coercive force of the magnetic wire is reduced again as shown in FIG. 4C, and thus the magnetoelastic coupling increases. For this reason, as shown in FIG. 3D, a voltage waveform of the amplitude which is almost the same as that shown in FIG. 3B is observed.

As discussed in the foregoing, although the cold wire drawing process makes it difficult to generate and detect the magnetoelastic waves, the propagation of the magnetoelastic waves become easy. Adversely, the magnetic properties of the magnetic wire are changed by the subsequent annealing process so that the generation and detection of the magnetoelastic wave becomes easy, but the propagation of the magnetoelastic waves becomes difficult.

As described before, the magnetic wire 10 shown in FIG. 1 is obtained by annealing the portions 20*a* and 20*b* of the magnetic wire obtained by the in-rotating-liquid spinning method and subsequent cold wire drawing process. Therefore, the magnetoelastic wave can be efficiently propagated through the portions other than the portions 20*a* and 20*b* of the magnetic wire. In addition, it is possible to easily generate the magnetoelastic waves in the magnetic wire by the driving coil provided around the annealed portion 20*a*, as shown in FIG. 2. Further, it is also possible to easily detect the magnetoelastic waves in the magnetic wire by the pick-up coil provided around the annealed portion 20*b*, as shown in FIG. 2.

FIG. 3E shows a voltage waveform for the magnetic wire of FIG. 1 to which the driving and pick-up coils 30*a* and 30*b* are provided around the annealed portions 20*a* and 20*b*, respectively. As seen from FIG. 3E, a signal of a large amplitude is detected, compared to the signals of FIGS.3B through 3D.

Figure 5:
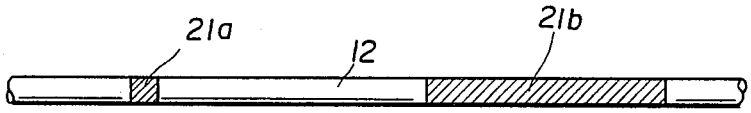
FIG. 5 is a front view of another amorphous magnetic wire according to the present invention.

FIG. 5 shows another example of the amorphous magnetic wire according to the present invention. An amorphous magnetic wire 12 is a wire obtained by annealing portions 21*a* and 21*b* of an amorphous magnetic wire, the whole of which has been already subjected to the cold wire drawing process. The annealed portion 21*b* is longer than the annealed portion 21*a*.

Figure 6:
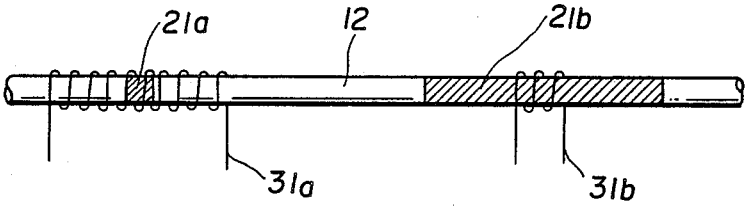
FIG. 6 is a front view of the amorphous magnetic wire shown in FIG. 5 to which a driving coil and a pick-up coil are added.

As shown in FIG. 6, a driving coil 31*a* is wound over a relatively long length of the wire including the annealed portion 21*a*. A pick-up coil 31*b* is wound over a narrow range within the annealed portion 21*b*. With this structure, it is possible to detect a distance between the annealed portion 21*a* and the center of the pick-up coil 31*b* by measuring a propagation time which corresponds to such a distance. In this case, when the magnetic wire 12 is moved in a direction of an arrow A, the detected propagation time becomes shorter. On the other hand, when the magnetic wire 12 is moved in the reverse direction, the propagation time becomes longer.

The above function of the magnetic wire 12 can be applied to a position detecting sensor, in which the magnetic wire 12 is supported so as to be movable with respect to the stationary coils 31*a* and 31*b*. An example of a position detecting sensor using the magnetic wire 12 will be described in detail later.

Figure 7:
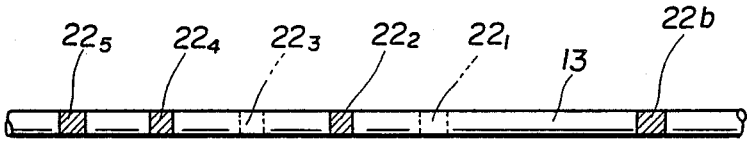
FIG. 7 is a front view of still another embodiment of the amorphous magnetic wire according to the present invention.

FIG. 7 shows still another embodiment of the amorphous magnetic wire according to the present invention. As in the embodiments described before, an amorphous magnetic wire 13 is a wire obtained by partially annealing the entirely drawn magnetic wire. In the illustrated example, portions $22_2$, $22_4$ and $22_5$ out of predetermined portions $22_1$ to $22_5$ of the magnetic wire 13 have been annealed. Further, a portion 22*b* which is located away from the portion $22_1$ has been annealed.

Figure 8:
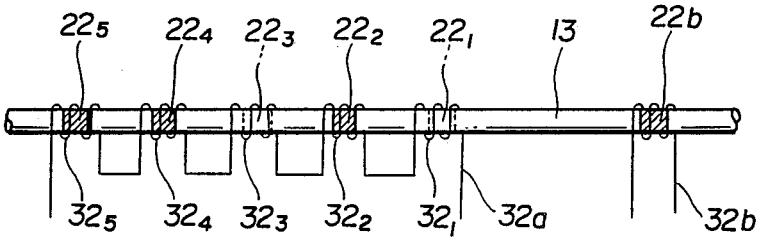
FIG. 8 is a front view of the amorphous magnetic wire shown in FIG. 7 to which a driving coil and a pick-up coil are added.

As shown in FIG. 8, a driving coil 32*a* is provided over a wire portion including the annealed portions $22_1$ to $22_5$. The driving coil 32*a* consists of five driving coils $32_1$ through $32_5$, which are wound around the annealed portions $22_1$ through $22_5$, respectively. In addition, a pick-up coil 32*b* is provided around the annealed portion 22*b*.

Figure 9:
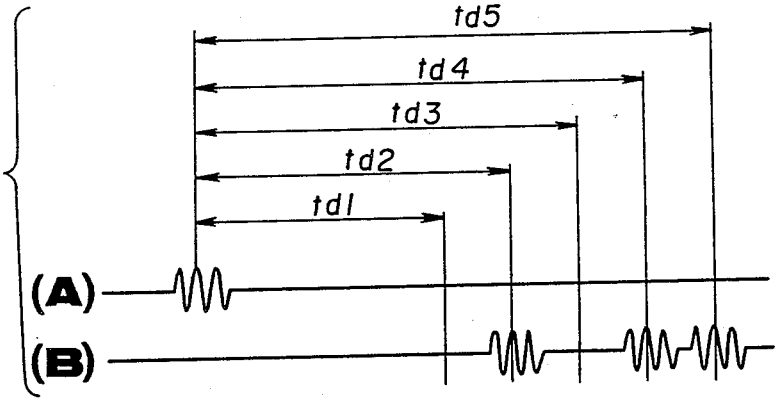
FIGS. 9A and 9B are views showing a waveform of a driving current and a waveform of a voltage detected, for the wire shown in FIG. 7.

When passing a driving current as shown in FIG. 9A through the driving coil 32*a*, magnetoelastic waves are simultaneously generated at the annealed portions $22_2$, $22_4$ and $22_5$. On the other hand, magnetoelastic waves are hardly generated at the non-annealed portions $22_1$ and $22_3$. When the magnetoelastic waves are propagated through the magnetic wire 13 and then reaches the annealed portion 22*b*, signals corresponding to the tone-burst current are detected by the pick-up coil 32*b*. In this case, distances between the annealed portions $22_2$, $22_4$ and $22_5$ and the annealed portion 22*b* are different from each other. Therefore, mutually different propagation times $td_2$, $td_4$ and $td_5$ are necessary for the waves generated at the portions $22_2$, $22_4$ and $22_5$ to reach the annealed portion 22*b*.

FIG. 9A shows a tone-burst current, and FIG. 9B shows a sequence of detected voltages in response to the tone-burst current of FIG. 9A. As seen from these figures, no voltage has been detected at propagation times $td_1$ and $td_3$ which correspond to distances between the non-annealed portions $22_1$ and $22_3$ and the annealed portion 22*b*, respectively. This is because less or no magnetoelastic wave are generated at the non-annealed portion $22_1$ and $22_3$. In this manner, it becomes possible to know annealed positions of the magnetic wire.

The magnetic wire 13 shown in FIG. 8 may be used as a non-volatile memory. For example, assuming that an annealed portion corresponds to "1" and a non-annealed portion corresponds to "0", the magnetic wire 13 of FIG. 8 can store information of five bits "01011". Therefore, the magnetic wire can store arbitrary five-bit information by arbitrary selection of annealed portions.

Figure 10:
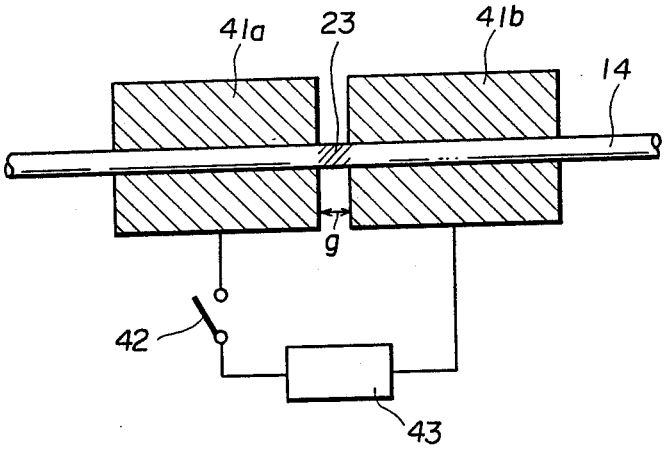
FIG. 10 is a view for explaining a heat treatment process according to the present invention.

The partial annealing treatment for the magnetic wire after the cold wire drawing process may be carried out, as shown in FIG. 10. The illustrated arrangement is designed to partially anneal the wire by passing a current through a portion to be annealed. A pair of metal electrodes 41*a* and 41*b* are attached on both sides of a portion 23 of a magnetic wire 14 to be annealed. The electrode 41*a* is connected to a current supply circuit 43 through a switch 42, and the electrode 41*b* is connected to the current supply circuit 43.

When the switch 42 is closed, a current from the current supply circuit 43 flows into the portion 23 corresponding to a gap g between the electrodes 41*a* and 41*b*. As a result, only the portion 23 of the magnetic wire 14 is heated. Instead of the arrangement of FIG. 10, an infrared light or laser beam may be used for the partial annealing treatment.

A description will be given on improvements in frequency characteristics provided by the amorphous magnetic wires according to the present invention, by referring to FIG. 11.

Figure 11:
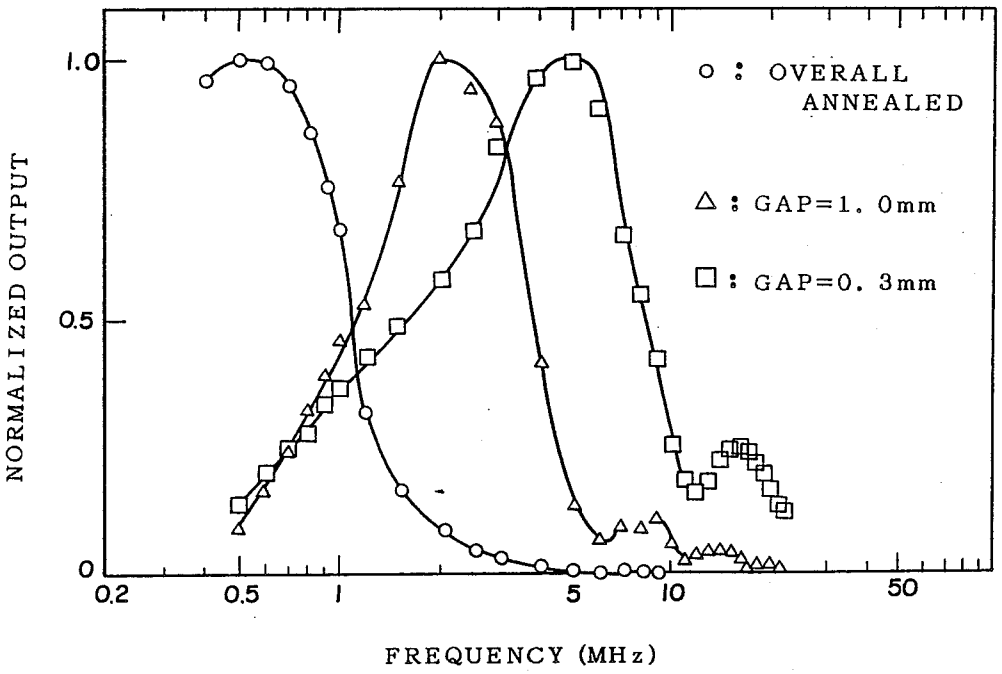
FIG. 11 is a graph for explaining improvements in frequency characteristics provided according to the present invention.

FIG. 11 shows experimental results of normalized output from a pick-up coil vs. frequency characteristics. In the experiment, wire-drawn amorphous magnetic wires ($Fe_{77.5}Si_{7.5}B_{15}$, 0.09 mm in diameter) were used as samples. The partial annealing treatment was carried out by using the configuration shown in FIG. 10. An experimental system used was the same as that shown in FIG. 2. The tone-burst current was applied to the driving coil 30*a* by the tone-burst generator. The signal detection was carried out by use of an oscilloscope which is connected to the pick-up coil 30*b* through the amplifier. In the measurement, three samples were prepared, i.e., an overall annealed magnetic wire (450° C., 30 min), a partially annealed magnetic wire with the gap g between the electrodes equal to 1.0 mm, and a partially annealed magnetic wire with the gap g of 0.3 mm.

The frequency characteristics of these samples are shown in FIG. 11, in which the detected output is normalized so that a maximum of the outputs becomes equal to 1. It will be understood from FIG. 11 that the annealed portion can generate and detect the magnetoelastic wave of a frequency higher than that for the overall annealed magnetic wire. Further, it can seen from this figure that the frequency characteristics are improved as the gap between the electrodes, i.e., the width of the annealed portion becomes narrower. From this viewpoint, the annealed portions 20*a*, 20*b*, 21*a*, 22*b* and $22_1$ to $22_5$ are preferably set to 1.0 mm or less in length depending on application of the magnetic wire. The annealed portion 21*b* may be greater than 0.1 mm in length. However, if the magnetic wire 12 of FIG. 5 is used for a position detecting apparatus, for example, the high-frequency is not an important factor.

A description will be given on an application of the amorphous magnetic wire according to the present invention with reference to FIG. 12.

Figure 12:
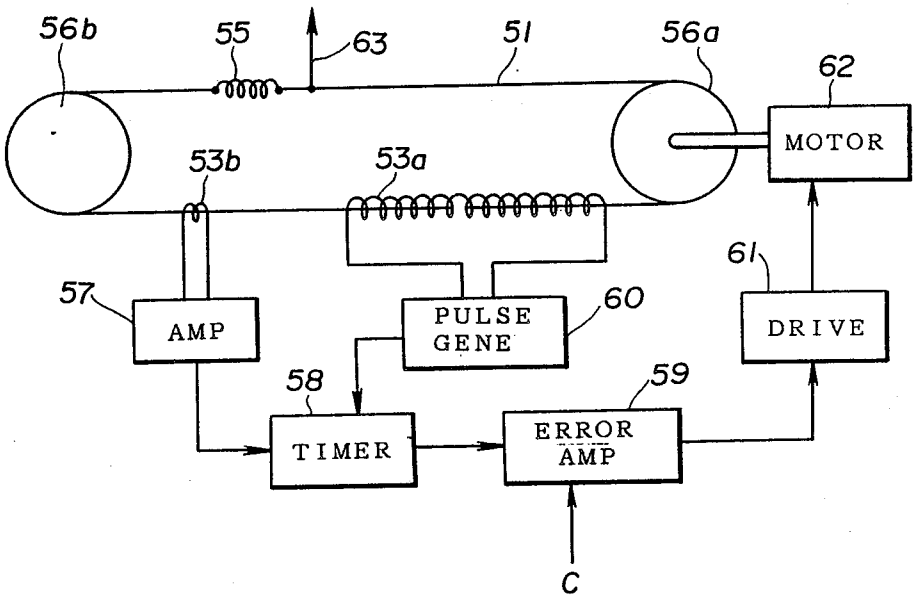
FIG. 12 is a circuit diagram of a position detecting apparatus which is an example of applications of the amorphous magnetic wire according to the present invention.

FIG. 12 shows a configuration of a position detecting apparatus which is designed for a pen recorder. An amorphous magnetic wire 51 according to the present invention is stretched between a pair of pulleys 56*a* and 56*b*. A coil spring 55 coupled with the magnetic wire 51 is used to adjust a stretch thereof. A pen 63 is attached to a portion of the magnetic wire 51. A wire portion opposite to the pen 63 is provided with annealed portions 21*a* and 21*b* shown in FIG. 5. A driving coil 53*a*is wound around the annealed portion 21*a*, and a pick-up coil 53*b* is wound around the annealed portion 21*b*. In addition to these coils, Helmholtz coils may be provided for applying a bias magnetic field to the magnetic wire 51 to facilitate the wave generation and detection. The driving coil 53*a*is provided with a pulse signal by a pulse generator 60. The pick-up coil 53*b* is connected to an amplifier 57, which amplifies a signal generated by the pick-up coil 53*b*. Output signals of the amplifier 57 and the pulse generator 60 are supplied to a timer circuit 58. The timer circuit 58 starts a counting operation in response to the application of the pulse signal, and counts a time taken until the signal is detected by the pick-up coil 53*b*. A counted time is a propagation time which indicates a position of the pen 63. The propagation time is fed to an error amplifying circuit 59, which compares the propagation time with an input signal C, and produces a control signal for positioning the pen 63 so as to be proportional to the input signal C. The output signal is supplied to a servo motor 62 through a driving circuit 61. The servo motor drives the pulley 56*a* so that the pen 63 can be moved to the designated position. In the above structure, the tone-burst signal may be used in place of the pulse.

The position detecting apparatus using the amorphous magnetic wire according to the present invention is excellent in terms of linearity. This is because the propagation velocity of the magnetoelastic wave in the wire has less or no variation. The velocity is 5 km/sec, for example.

The present invention is not limited to the embodiments, but various variations and modifications may be made without departing from the scope of the present invention.

What is claimed is:

1. An amorphous elongated magnetic wire comprising: first and second parts which occupy exclusively distinct sections of a length of said amorphous magnetic wire, said first part entirely comprised of a magnetically hard wire portion for propagating a magnetoelastic wave, said second part entirely comprised of a magnetically soft wire portion for generating or detecting the magnetoelastic wave.

2. An amorphous magnetic wire as claimed in claim 1, wherein the magnetically soft portion has been annealed.

3. An amorphous magnetic wire as claimed in claim 1, wherein the amorphous magnetic wire is made of ferromagnetic substance.

4. An amorphous magnetic wire as claimed in claim 3, wherein a main component of the ferromagnetic substance is selected from the group consisting of iron (Fe), cobalt (Co) and nickel (Ni).

5. An amorphous magnetic wire as claimed in claim 1, wherein a diameter of the amorphous magnetic wire is not more than 0.11 mm.

6. An amorphous magnetic wire as claimed in claim 1, wherein said second part includes two magnetically soft wire portions between which the magnetically hard wire portions is intervened, and one of the magnetically soft wire portions is useful for generating a magnetoelastic wave, and the other is useful for detecting the magnetoelastic wave which is propagated through the magnetically hard wire portion.

* * * * *